US006099076A

United States Patent [19]

Nagel et al.

[11] Patent Number: 6,099,076

[45] Date of Patent: Aug. 8, 2000

[54] CHAIR BACK CONSTRUCTION

[75] Inventors: Duane F. Nagel, Grand Rapids; Daniel P. Beemer, Wyoming; Dale M. Groendal, Jenison; Jeffrey A. Hall, Grand Rapids; Edward L. Tyler, Caledonia, all of Mich.

[73] Assignee: Steelcase Development Inc., Grand Rapids, Mich.

[21] Appl. No.: 09/443,522

[22] Filed: Nov. 19, 1999

Related U.S. Application Data

[62] Division of application No. 09/034,188, Mar. 3, 1998.

[51] Int. Cl.[7] ..... A47C 1/023

[52] U.S. Cl. ..... 297/337; 297/452.38; 297/440.2; 297/313

[58] Field of Search ..... 297/337, 311, 297/452.38, 440.2, 313, 322, 284.7

[56] References Cited

U.S. PATENT DOCUMENTS

| | | | |
|---|---|---|---|
| 2,550,831 | 5/1951 | Lingenfelter . | |
| 2,756,809 | 7/1956 | Endresen . | |
| 2,991,124 | 7/1961 | Schwarz . | |
| 3,463,544 | 8/1969 | Froelich . | |
| 3,663,057 | 5/1972 | Lohr et al. . | |
| 3,695,696 | 10/1972 | Lohr et al. . | |
| 4,123,105 | 10/1978 | Frey et al. . | |
| 4,156,544 | 5/1979 | Swenson et al. . | |
| 4,182,533 | 1/1980 | Arndt et al. . | |
| 4,239,282 | 12/1980 | White . | |
| 4,541,670 | 9/1985 | Morgenstern et al. . | |
| 4,632,454 | 12/1986 | Naert . | |
| 4,634,176 | 1/1987 | Scott . | |
| 4,634,178 | 1/1987 | Carney . | |
| 4,676,550 | 6/1987 | Neve De Mevergnies . | |
| 4,722,569 | 2/1988 | Morgenstern et al. . | |
| 4,730,871 | 3/1988 | Sheldon . | |
| 4,746,168 | 5/1988 | Bracesco . | |
| 4,799,736 | 1/1989 | Kassai . | |
| 4,811,986 | 3/1989 | Hattori et al. . | |
| 4,834,455 | 5/1989 | Proctor . | |
| 4,900,085 | 2/1990 | Tobler . | |
| 4,909,572 | 3/1990 | Kanai | 297/452.36 |
| 4,950,032 | 8/1990 | Nagasaka . | |
| 5,015,038 | 5/1991 | Mrotz, III | 297/452.38 |
| 5,022,709 | 6/1991 | Marchino . | |
| 5,102,196 | 4/1992 | Kaneda et al. . | |
| 5,112,106 | 5/1992 | Asbjornsen et al. . | |
| 5,261,723 | 11/1993 | Hosoe | 297/322 |
| 5,281,002 | 1/1994 | Dauphin . | |
| 5,297,851 | 3/1994 | Van Hekken . | |
| 5,314,240 | 5/1994 | Ishi et al. . | |

(List continued on next page.)

*Primary Examiner*—Anthony D. Barfield
*Attorney, Agent, or Firm*—Price Heneveld Cooper Dewitt & Litton

[57] ABSTRACT

A chair includes a base, a seat operably supported on the base for depth adjustment, and a back operably supported by an upright that extends from the base for recline. The back includes a structural back support, a rear cover covering a rear side of the back support, and a front/lower concave cover covering the upright between a rear of the seat and below the back support to provide a one-piece back and seat appearance. The concave cover defines a concavity shaped to receive a rear of the seat to facilitate depth adjustment, but so that the one-piece back and seat appearance is maintained. The concave cover further includes upwardly extending tabs that engage a lower marginal edge of the back support to facilitate assembly. A flexible sheet covers a front side of the back, and includes a lower portion that wraps around the lower marginal edge and onto a rear surface of the back support, and the concave cover includes an upwardly facing flange that overlaps the lower marginal edge of the back support to trap the lower portion against the lower marginal edge. A vertically adjustable lumbar support is operably mounted on the back support for vertical movement, and handles are provided that move along vertical side edges of the back along a path that is non-parallel the vertical path of the lumbar support.

15 Claims, 7 Drawing Sheets

U.S. PATENT DOCUMENTS 5,326,155 7/1994 Wild .
5,335,965 8/1994 Sessini .
5,338,099 8/1994 Ishi et al. .
5,460,427 10/1995 Serber .
5,474,358 12/1995 Maeyaert .
5,494,332 2/1996 Daniel .
5,538,326 7/1996 Lorbiecki .
5,542,743 8/1996 Olson et al. .
5,567,010 10/1996 Sparks .
5,567,011 10/1996 Sessini .
5,582,460 12/1996 Schultz .
5,599,069 2/1997 Lorbiecki .
5,630,650 5/1997 Peterson et al. .
5,641,205 6/1997 Schmidt .
5,658,047 8/1997 Ratza et al. .
5,782,536 7/1998 Heidmann et al. ..... 297/337
5,820,221 10/1998 Greaves et al. .
5,947,559 9/1999 Williams ..... 297/337

CHAIR BACK CONSTRUCTION

CROSS REFERENCE TO RELATED APPLICATIONS

This application is a divisional of application Ser. No. 09/034,188, filed Mar. 3, 1998, entitled CHAIR BACK CONSTRUCTION.

BACKGROUND OF THE INVENTION

The present invention relates to chair back constructions, and more particularly relates to a back construction providing a one-piece back and seat appearance suitable for executive and manager chairs, the back construction including features providing adjustability and facilitating assembly.

Many chairs include adjustable backs and seats that can be adjusted to fit users having different body shapes and to optimize comfort while performing particular tasks. Modern consumers also demand an attractive appearance, particularly in highly stylized, "high end" chairs for managers and executives, where status and style are important considerations. Specifically, in manager and executive chairs, a one-piece seat and back appearance is often desired to provide an impressive stylistic appearance with continuous uninterrupted lines extending from the seat through the back, and where the visual effect between the back and seat is minimized. Such styles may also benefit from an expensive looking massive appearance. However, a one-piece seat and back appearance limits the seat depth adjustment since there is no space at a rear of the seat below the back to receive the rear of the seat. Concurrently, the seat cannot be positioned too far forward, or the resulting cavern at the rear of the seat detracts from the appearance of the chair. Also, the seat may not adequately support a seated user if the seat is positioned too far forward, particularly where the seated user has a small buttock and reclines in the chair. Lack of space at a rear of the seat also limits angular adjustment/forward tilting of the seat, since the rear of the seat will engage the bottom of the back preventing significant tilting adjustment. It is noted that chairs having a gap between the back and the seat do have a space for the seat to enter when depth-adjusted rearwardly, however the "one-piece back and seat appearance" is lost because of the see-through area thereby created.

Another problem with highly stylized chairs is the need for adequate adjustability of lumbar support. Managers and executives often sit in their chairs for hours at a time, and adequate lumbar support is essential to comfortably perform their jobs. Further, the lumbar support must be adjustable to allow changes in support as the seated user's back fatigues and different amounts and distributions of back support are needed. However, in stylized chairs, the side edges of the backs are often not vertical nor linear. This results in a problem because the adjustment handle of the lumbar support cannot simply move vertically, since it would stick out an unacceptable amount in one position or another. Often mechanisms are used to provide vertical adjustability of an adjustable lumbar support; however, such mechanisms are expensive to assemble, include "too many" parts and pieces, and are subject to warranty problems. Further, the mechanism may have a non-uniform feel, which is unacceptable in "high end," highly stylized chairs.

Accordingly, a back construction is desired solving the aforementioned problems, but that provides the adjustability, low cost, and ease of assembly needed in the competitive chair industry.

SUMMARY OF THE PRESENT INVENTION

In one aspect of the present invention, a chair includes a seat, a base operably supporting the seat for movement between different depth-adjusted positions, and a back. The back includes a back support adapted to support a back of a seated user and an upright extending from the base that supports the back support on the base. The back further includes a concave lower cover that covers at least a front lower portion of the back support and a rear lower portion of the upright to provide a one-piece back and seat appearance. The concave lower cover defines a concavity at a rear edge of the seat and is configured to receive the seat when the seat is moved into at least one of the depth-adjusted positions.

In another aspect of the present invention, a chair includes a seat, a base operably supporting the seat for movement between different depth-adjusted positions, and a back positioned with respect to the seat to support a seated user. An upright interconnects the back to the seat, the upright having a pair of spaced apart members defining a distance therebetween sufficient to receive a rear of the seat when the seat is depth-adjusted in a rearward direction. A concave cover covers a part of the upright, the concave cover having a first portion located on a front side of the upright and a second portion located on an opposite side of the upright.

These and other inventive aspects, objects, and advantages will become apparent to one of ordinary skill in the art upon review of the attached specification, claims, and appended drawings.

DETAILED DESCRIPTION OF PREFERRED EMBODIMENT

Figure 1:
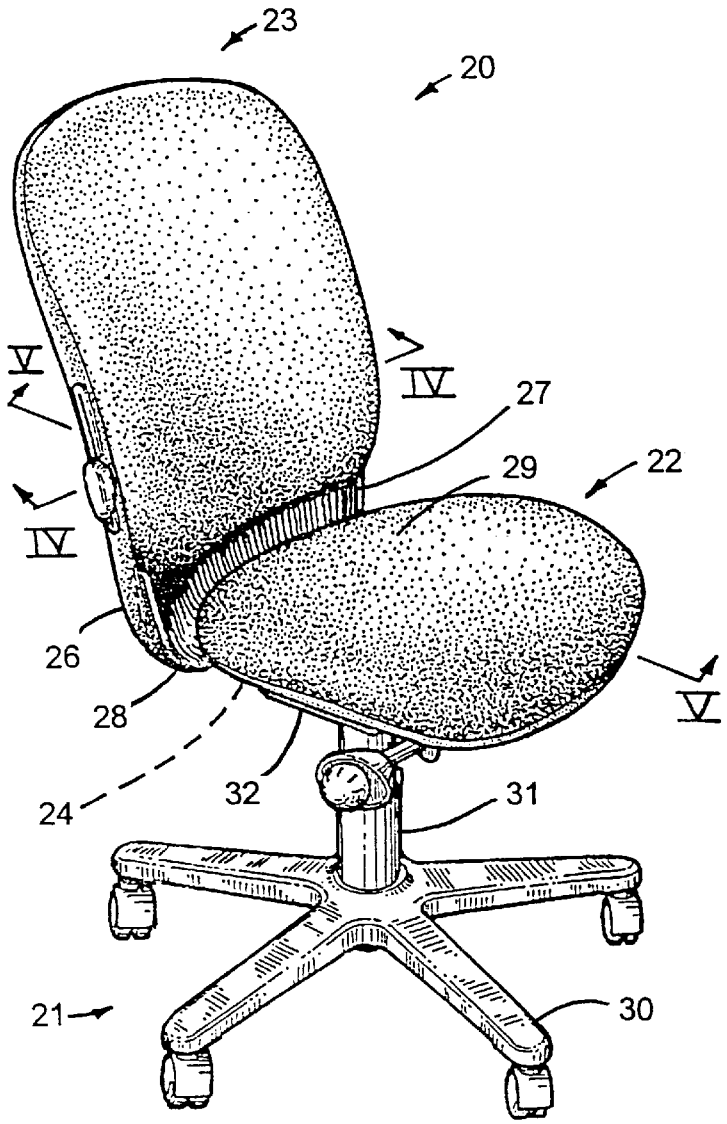
FIG. 1 is a perspective view of a chair embodying the present invention.

A chair 20 (FIG. 1) embodying the present invention includes a base 21, a seat 22 operably supported on the base 21 for depth adjustment, and a back 23 operably supported by an upright 24 that extends from the base 21 for supporting the back 23 and for biasing the back 23 from a reclined position toward an upright position. The back 23 includes a structural back support 25, a rear cover 26 covering a rear side of the back support 25, and a front/lower concave cover 27 covering that part of the upright 24 that is located between a rear of the seat 22 and below the back support 25 to provide a one-piece back and seat appearance. The concave cover 27 defines a concavity 28 shaped to receive a rear 29 of the seat 22 to facilitate an extended depth adjustment, but so that the one-piece back and seat appearance of the chair 20 is maintained.

Figure 10:
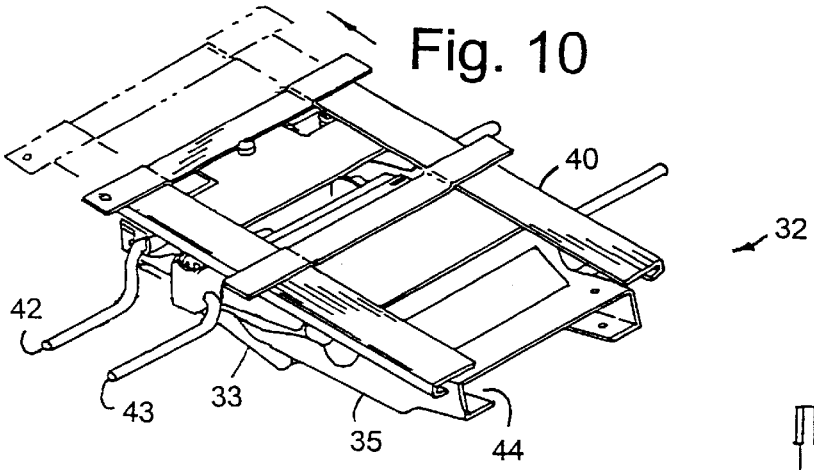
FIG. 10 is a perspective view of the control shown in FIG. 1 for supporting the upright of FIG. 9.
Figure 11:
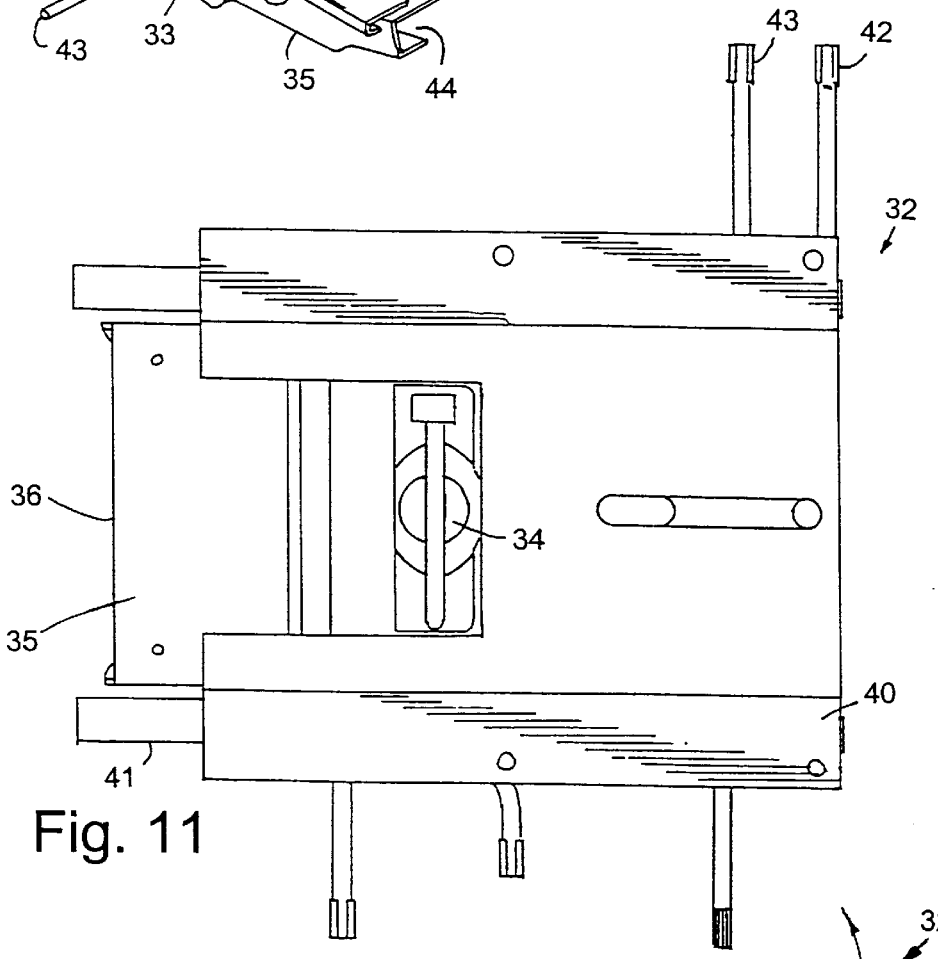
FIGS. 11 and 12 are top and side views of the control shown in FIG. 10.
Figure 12:
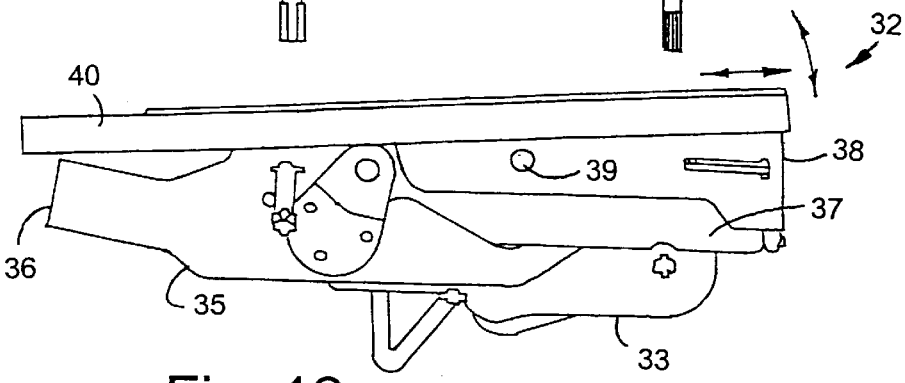

The base 21 (FIG. 1) includes a multi-legged base frame 30 with castors on ends of the legs, and a telescopingly extendable center tube 31 that extends vertically from the base frame 30 into a control 32. The illustrated control 32 (FIGS. 10–12) is a synchrotilt control adapted to simultaneously tilt the seat 22 and back 23 during recline, and also adapted to allow manual adjustment of both the seat depth and the seat tilt angle when the chair 20 is in the upright position. The illustrated control 32 provides excellent advantages in combination with the other inventive aspects discussed below by providing synchrotilt movement of a seat and back. The features and operation of control 32 providing these advantages are discussed below in sufficient detail to provide an understanding of the present invention. If a greater understanding of control 32 itself is desired, it is noted that control 32 is disclosed in detail in U.S. Pat. No. 5,630,647. Even though the disclosed embodiment is illustrated in combination with a particular synchrotilt control, it is to be understood that the present invention is contemplated to include other synchrotilt controls, chairs not having synchrotilt controls, and chairs having either reclinable or fixed backs.

Control 32 (FIGS. 10–12) includes a housing 33 having a hole 34 shaped to securely receive an upper end of the center tube 31. A back-supporting bracket 35 is pivoted to the housing 33, and includes a rearwardly facing mounting throat 36 for receiving a box-shaped end 44 (FIG. 2) of the upright 24. A spring (not specifically shown) is operably mounted in housing 33 (FIGS. 10–12) for biasing the back-supporting bracket 35 toward an upright position. A synchrotilt bracket 37 is pivoted to the back-supporting bracket 35 and operably movably mounted to the housing 33 for giving the seat 22 a synchronous motion as the back 23 is reclined. A seat-supporting structure is mounted on synchrotilt bracket 37, including a tiltable bracket 38 (FIG. 12) pivoted to synchrotilt bracket 37 at pivot 39, and a depth-adjustable bracket 40 slidably mounted on tiltable bracket 38 at side flanges 41. A tilt latch mechanism and handle 42 and a depth-adjustable mechanism and handle 43 are mounted on the sides of the control 32. Seat 22 is attached to the bracket 40.

Upright 24 (FIG. 2) includes a box-shaped end section 44 constructed to closely mateably engage the throat 36 on control 32. A pair of tubular arms 45 extend laterally outwardly and then upwardly from end section 44. An apertured flange 46 (FIG. 3) extends from each arm 45 at a location spaced from the end 47 of each arm 45. Each end 47 is configured to fit into a recess in back support 25 formed by an arched section of material 48 in back support 25. Concurrently, each apertured flange 46 aligns with a mounting boss of the back support 25 for receiving an attachment screw 49 to secure the arms to respective sides of the back support 25.

Figure 5:
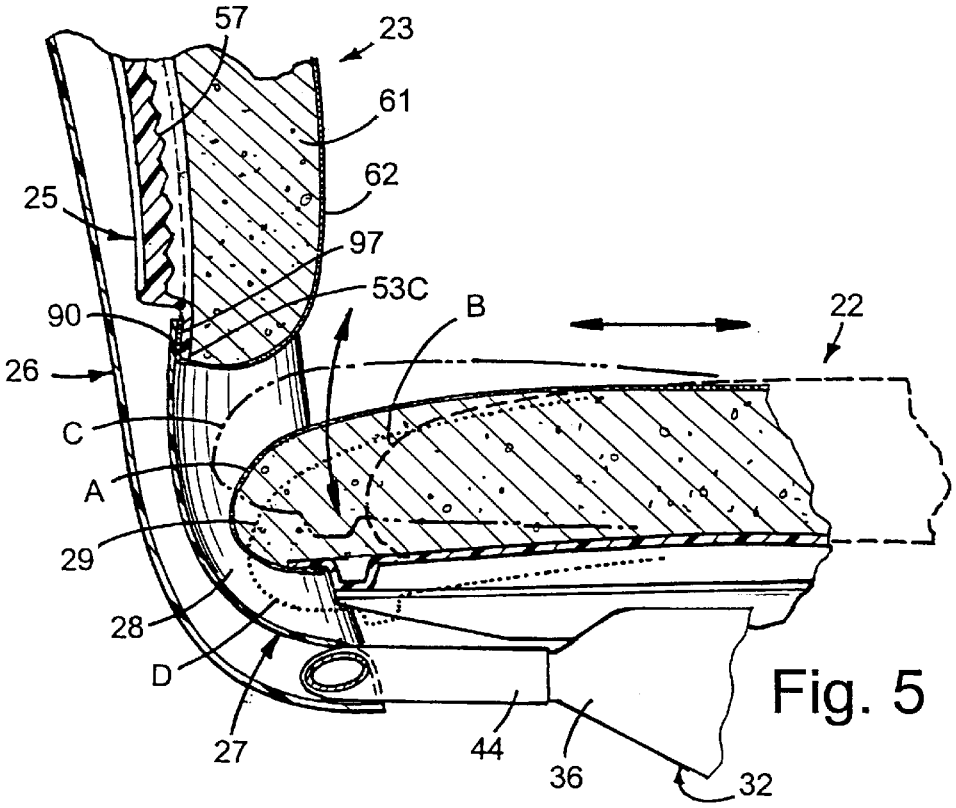
FIG. 5 is a vertical cross section taken along the plane V—V in FIG. 1.

The illustrated seat 22 (FIG. 1) is cushioned and covered with a sheet of upholstery or the like, and is attached to the depth-adjustable bracket 40 for depth adjustment therewith. When the seat 22 is depth-adjusted rearwardly to a position A (FIG. 5), a rear 29 of the seat 22 extends into the concavity 28. At a rearmost position, the seat 22 may actually engage the concave cover 27. When the seat 22 is depth-adjusted forwardly to position B (see dashed lines), the rear 29 of the seat 22 exits the concavity 28, but the concave cover 27 maintains the one-piece back and seat appearance because the recess of concave cover 27 is relatively dark and because the contours of concave cover 27 are blended and radiused to de-emphasize the existence of the concavity 28. The rear 29 of the seat 22 also moves within the concavity 28 when the seat 22 is angularly adjusted and tilted, such as between a forwardly tilted position C (see dot-dash lines) and a rearwardly tilted position D (see dotted lines).

The back support 25 (FIG. 2) includes a center region having flat areas 51 interconnected by U-shaped or trapezoidally-shaped stiffening channels 52, and a relatively flat perimeter flange 53 that extends around all four sides of the center region. Specifically, the perimeter flange 53 includes side portions 53A and 53B, a bottom portion 53C, and a top portion 53D. The flat areas 51 provide support to a back cushion 61 (FIG. 5) and to a lumbar support 56 (FIG. 2) as discussed below. The stiffening channels 52 are strategically located to selectively stiffen the back support 25, but provide it with a desired amount of flexibility in selected directions so that the back flexes with a seated user's torso as the seated user leans and twists in the chair when reclining, yet so that the seated user receives adequate postural support. The arched section 48 is located in perimeter flange 53 slightly above its midpoint, and an aperture 54 is formed in perimeter flange 53 to facilitate molding of the arched section.

Figure 2A:
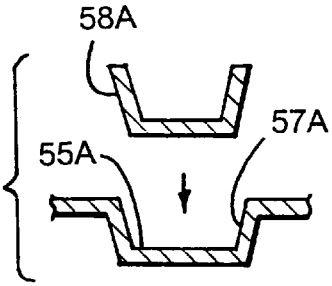
FIG. 2A is an exploded cross-sectional view taken horizontally through a modified vertical center track on the back support and through a modified follower on the lumbar support.
Figure 2:
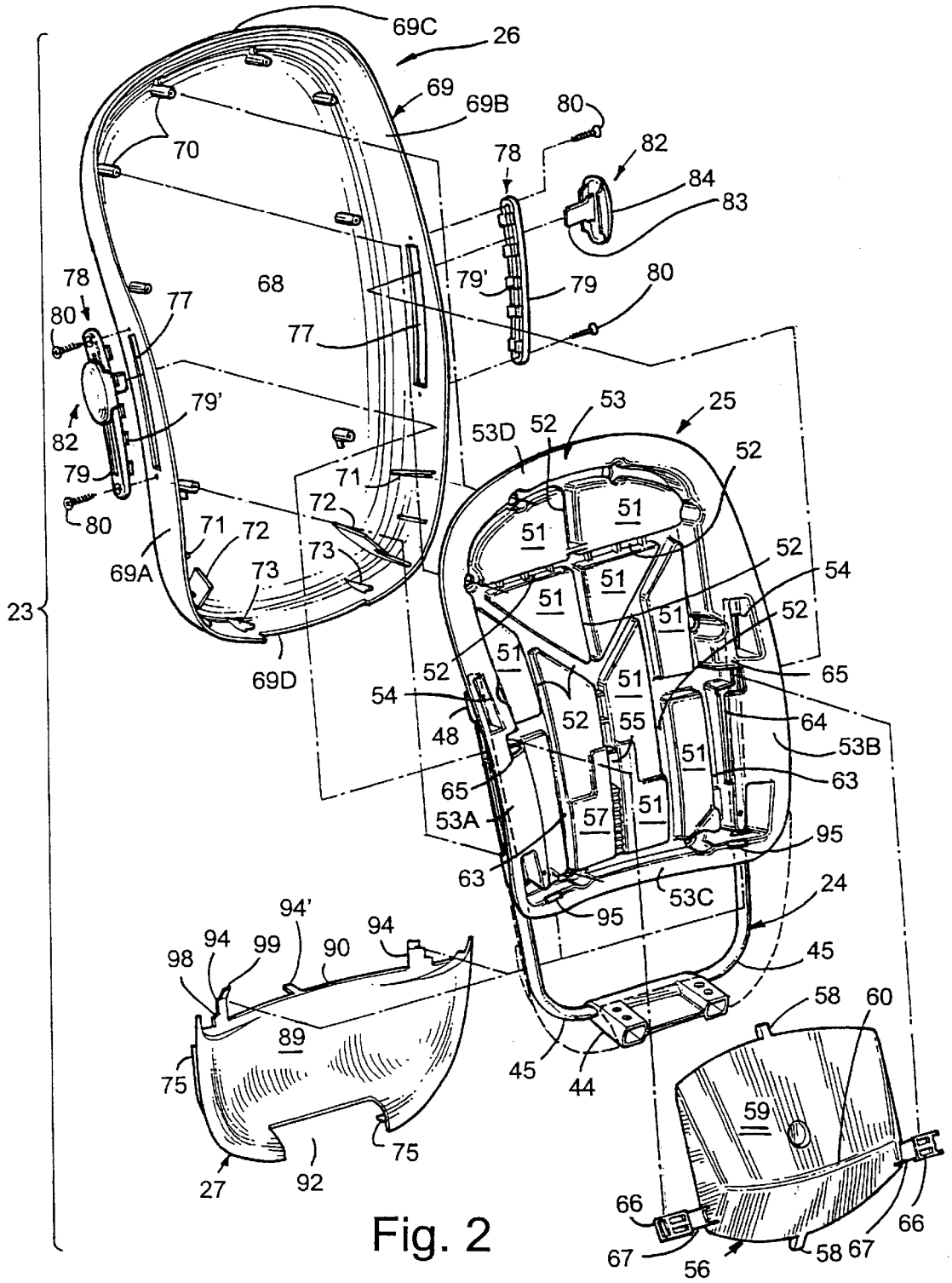
FIG. 2 is an exploded perspective view of the back shown in FIG. 1, the back cushion and flexible sheet upholstery covering the back being removed to clearly show the components.
Figure 3:
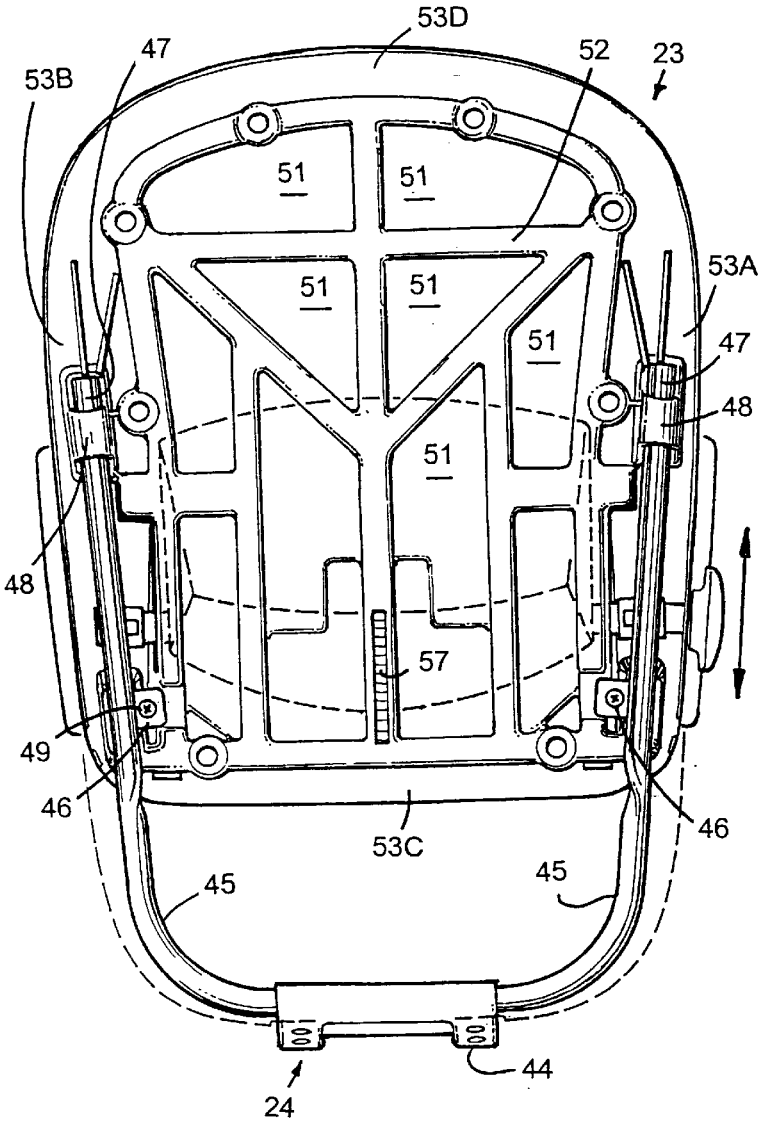
FIGS. 3 and 4 are rear and side views of the back shown in FIG. 2.
Figure 4:
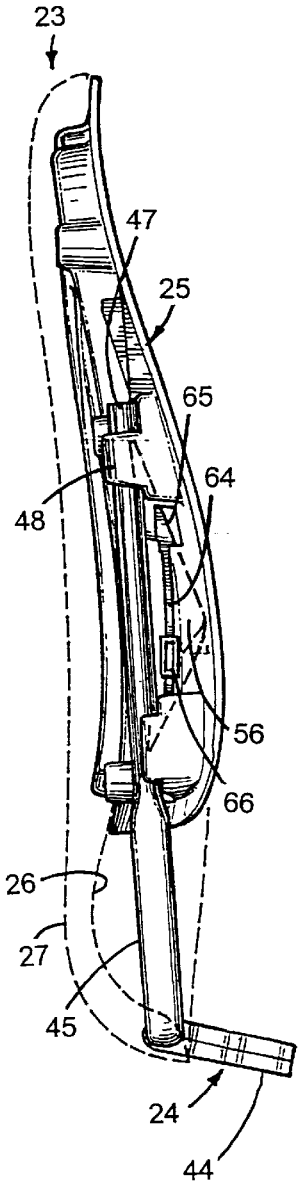
Figure 6:
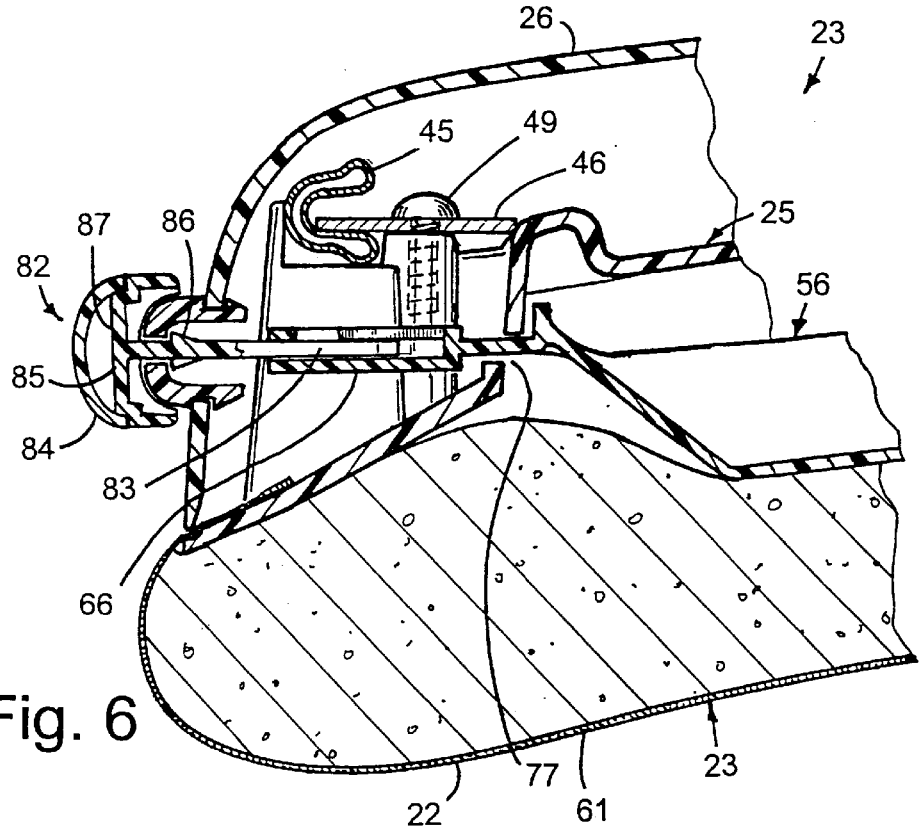
FIG. 6 is a horizontal cross section taken along the plane VI—VI in FIG. 1.

One of the stiffening channels is located in a center of the back support 25 and extends generally vertically to form a vertical track 55 for guiding movement of a vertically adjustable lumbar support 56 (FIG. 2). The vertical track 55 has uneven surfaces and ridges 57 therein, and the lumbar support 56 includes top and bottom followers 58 that frictionally engage the track 55 and that form a detent with the uneven surfaces 57 to hold the lumbar support 56 in a selected vertically adjusted position. Notably, as illustrated in FIG. 2A, the uneven surface 57A can be on a side of the track 55A or on a side of the follower 58A, and further these surfaces can be angled so that they wedge together as a seated user leans on the back 23. The lumbar support 56 includes a lumbar cushion 59 having a flat back surface shaped to slide over the flat areas 51, and a protruding front 60 shaped to provide adjustable optimal lumbar support. Specifically, the protruding front 60 engages a back cushion 61 (FIG. 5) positioned on a front side of the back support 25, and changes the shape of the back cushion 61 as the lumbar support 56 is adjusted. Alternatively, it is contemplated that the lumbar support could be positioned on a front of the back cushion and under the flexible sheet 62 of upholstery material covering the back 23. Another stiffening channel 63 is located on each side of back support 25 immediately inside of the perimeter flange 53. A vertically elongated aperture or slot 64 is formed along an outside wall of the channel 63, and has an enlarged top forming an opening 65. The lumbar support 56 includes laterally extending end sections 66 on each side. The end sections 66 are shaped to be extended through the enlarged openings 65 during assembly. The end sections 66 include a necked section 67 shaped to slide along the aperture 64 with the lumbar end sections 66 sliding under the side portions 53A and 53B of perimeter flange 53 (FIG. 6).

Rear cover 26 (FIG. 2) includes a large panel 68 shaped to aesthetically cover a rear side of the back 23. The rear cover 26 includes a forwardly extending perimeter/marginal flange 69 having side portions 69A and 69B, top portion 69C, and bottom portion 69D that partially cover side surfaces of the back 23. Apertured bosses 70 for receiving snap-on fasteners or screws are formed on rear cover 26 to receive snap-on fasteners or screws installed through back support 25 to attach the rear cover 26 to the back support 25. Stiffening ribs 71, 72, and 74 are formed on panel 68 and marginal flange 69 to stiffen the rear cover 26. The ribs 72 on the rear cover 26 are configured to receive one side of an S-clip 73 (FIG. 7) to retain the concave cover 27 to the rear cover 26. The four notched ribs 71 and 74 in rear cover 26 (FIG. 7) are configured to engage a curvilinear rib 75 on concave cover 27. The engagement of the ribs 71, 74, and 75 assists in retaining the concave cover 27 to the rear cover 26, and also aligns the bottom edges of the covers 26 and 27.

A slot 77 (FIG. 2) is formed in each of the side portions 69A and 69B of the perimeter flange 69 of rear cover 26 at a location proximate the elongated apertures 64 in back support 25. The slot 77 forms sidetracks in the back 23 that extend along a portion of the perimeter of the back 23. The perimeter of the back 23 is curvilinear, such that the sidetracks extend non-parallel the vertical center track 55. A trim piece 78 is attached to each of the slots 77, and includes a looped body 79 that aesthetically covers the slot 77, and further includes hooked legs 79' that extend through and snap lock into the slot 77. Screws 80 may be extended through screw holes 81 in each end of the trim pieces 78 into the perimeter flange 69 where it is desirable to more positively secure the trim pieces 78 to the perimeter flange 69.

A handle 82 (FIG. 6) includes an inboard section 83 that telescopingly engages the end section 66 of the lumbar support 56. The handle 82 further includes a finger grip 84 that extends outwardly that a user can grasp for adjusting the lumbar support 56. Between the inboard section 83 and the finger grip 84 is an intermediate section forming a guide 85 for slidably engaging the trim pieces 78 and the slot 77. The guide 85 includes inboard protrusions 86 and an outboard protrusion or wall 87 that engage opposing sides of the body 79 in the slot 77. Accordingly, when a user wants to vertically adjust the lumbar support 56, the user grasps one or both of the handles 82 and moves them upwardly or downwardly along the perimeter flange 69. As the handle 82 moves, it telescopes into or out of the end section 66 of the lumbar support 56 as the lumbar support 56 concurrently moves vertically in a path non-parallel the handle 56. The vertical spacing of the top and bottom followers 58 cause the lumbar support 56 to move without binding or cocking, even if only one handle 82 is grasped and biased by the user.

Figure 7:
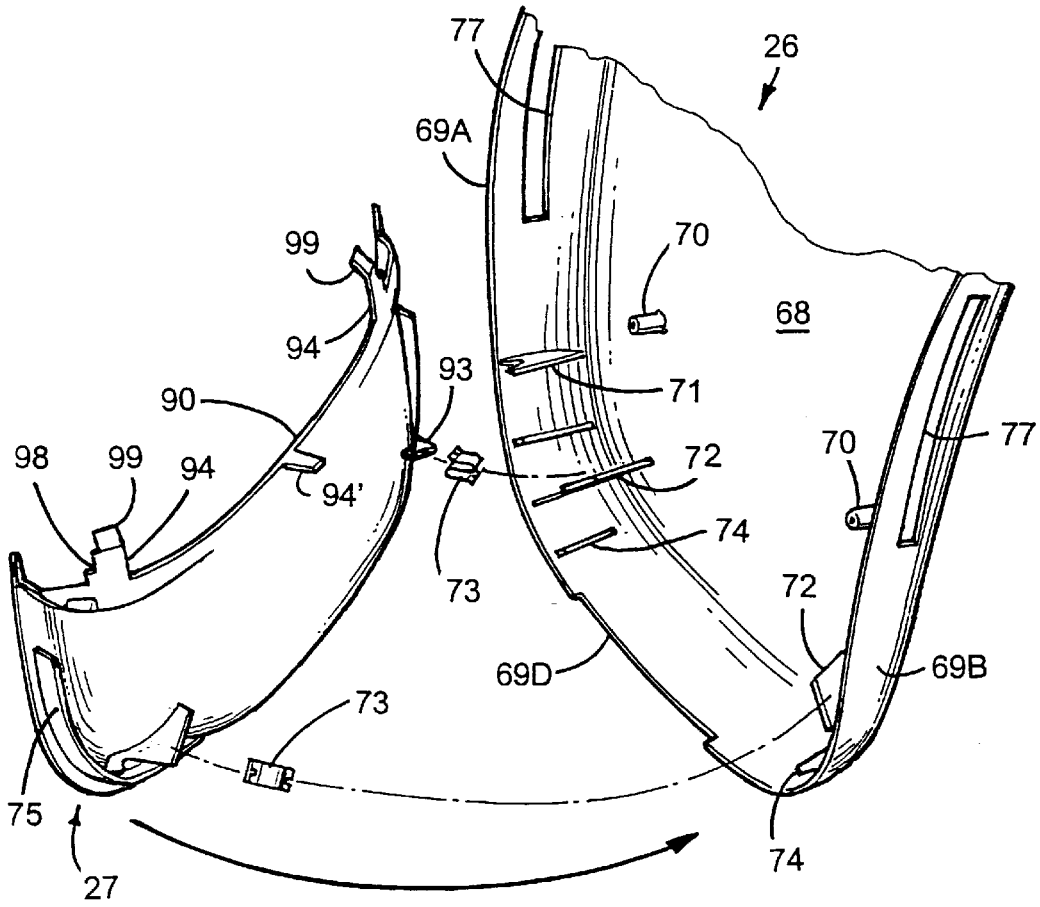
FIG. 7 is a perspective view showing assembly of the lower/front concave cover to the rear back cover.
Figure 8:
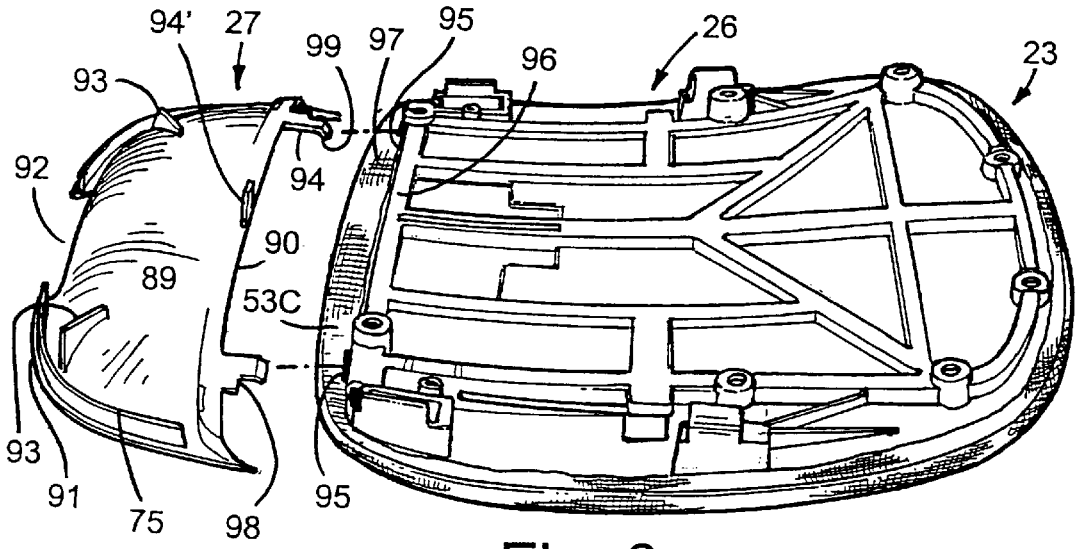
FIG. 8 is a perspective view showing assembly of the back including assembly of the concave cover shown in FIG. 7 with an assembly of the back support, the back cushion, and the flexible sheet upholstery covering the back support and back cushion.
Figure 9:
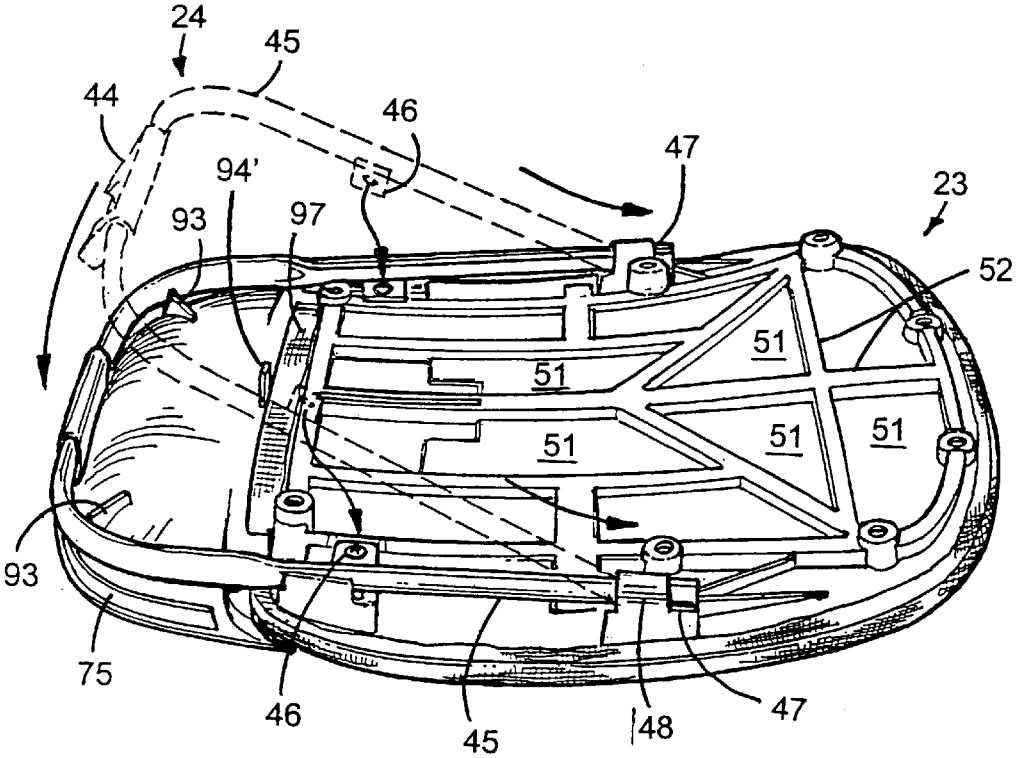
FIG. 9 is a perspective view showing assembly of an upright to the assembly of FIG. 8, including assembly of the spaced apart arms of the upright into the back support.

The concave cover 27 (FIG. 8) has a concavely-shaped body panel 89 having an upper marginal flange 90 and a lower marginal edge 91 that extends generally perpendicularly to the body panel 89. The curvilinear rib 75 extends along lower marginal edge 91. A cutout 92 is formed in a center of the lower edge 91 to receive the box-shaped end section 44 of upright 24. Ribs 93 are formed proximate lower marginal edge 91 for engaging the S-clip 73 to retain the concave cover 27 to the rear cover 26 (FIG. 7). A plurality of spaced apart tabs 94 are formed along the upper marginal flange 90 for engaging slots 95 along the bottom of back support 25. The slots 95 are located on an outer wall of a bottom horizontal stiffening channel 96 (i.e. the lowermost one of the stiffening channels 63) and is located inboard of the perimeter flange 53C. A lower section of the flexible sheet of upholstery 62 wraps around the lower marginal edge of the back support 25 and includes an "up" portion 97 that extends onto a lower rear surface of the perimeter flange 53C. The upper marginal flange 90 of the concave cover 27 overlaps on the rear side of the perimeter flange 53C and abuttingly engages the "up" portion 97 of the sheet 62. The upper marginal flange 90 of the concave cover 27 clampingly, frictionally engages the "up" portion 97 of the flexible sheet 62 (FIG. 5) and helps hold the "up" portion 97 both because it frictionally presses the "up" portion 97 against the perimeter flange 53C to frictionally retain it, and also because it holds any staples or other mechanical fasteners in place that are extended through the "up" portion 97 into the perimeter flange 53C. Notably, the tabs 94 include a step 98 (FIG. 8) that, along with a tab 94', locates them at a proper depth in the slots 95, and further include an obtusely angled leading end 99 (i.e. angles at about 45 degrees to the rest of the tab 94) that facilitates assembly as the concave cover 27 is tipped and slid into position on the back support 25.

It is noted that the flexible sheet 62 can be upholstery, leather, fabric, or other suitable covering material. Alternatively, in some chair designs, a flexible sheet may not be used at all. In such event, the present invention is contemplated to provide advantages of overlapping flanges that block out light and prevent see-through.

The present chair includes a seat operably supported for depth adjustment, and a back operably supported by an upright for movement between upright and reclined positions. The back includes a structural back support, a rear cover covering a rear side of the back support, and a front/lower concave cover covering that part of the upright that is located between a rear of the seat and below the back support to provide a one-piece back and seat appearance. The concave cover defines a concavity shaped to receive a rear of the seat to facilitate depth adjustment, but so that the one-piece back and seat appearance is maintained. The concave cover further overlaps a lower edge of the back support to prevent see-through, and further includes tabs that engage the back support to facilitate assembly, and still further engages a rear of the back support to help hold a lower edge portion of upholstery wrapped around a lower marginal edge of the back support. Still further, a rear cover is provided that covers a rear of the back support. Also, a vertically adjustable lumbar support is provided that follows a vertical track in the back support, and laterally extending handles are provided for adjusting the lumbar support, the handles tracking along sides of the back along paths that are non-parallel the movement of the lumbar support.

While the preferred embodiment has been described in some detail, those skilled in the art will recognize that various alternatives may be used that embody the invention described by the following claims. Accordingly, these claims are not intended to be interpreted as being unnecessarily limiting.

The invention claimed is:

1. A chair comprising:

a seat;

a base operably supporting the seat for movement between different depth-adjusted positions; and a back including a reclinable upright operably supported on the base, and a back support attached to the upright for supporting a seated user's upper body during recline, the back further including a concave lower cover that covers at least a front lower portion of the back support and a rear lower portion of the upright to provide a one-piece back and seat appearance, the concave lower cover defining a concavity at a rear edge of the seat and the seat being located in the concavity when in at least one of the depth-adjusted positions.

2. The chair defined in claim 1 wherein the lower cover includes a first portion located on front side of said upright and a second portion located on a rear side of said upright, the second portion forming a part of said concavity.

3. The chair defined in claim 2 wherein the back includes a rear cover that covers a rear surface of the back and that attaches to the lower cover.

4. The chair defined in claim 3 wherein the lower cover includes an upper marginal edge that overlaps and is rearward of a lower marginal edge of the back support.

5. The chair defined in claim 4 wherein the back includes a flexible sheet covering a front region of the back support, the flexible sheet including a lower edge that wraps around the lower marginal edge and that extends upwardly between the lower marginal edge of the back support and the upper marginal edge of the lower cover.

6. The chair defined in claim 1 wherein the lower cover includes an upper marginal edge that overlaps and is rearward of a lower marginal edge of the back support.

7. The chair defined in claim 1 wherein the back support includes a vertical center track and including a vertically adjustable lumbar support having a follower operably engaging the center track for vertical adjustment.

8. The chair defined in claim 1 wherein the back is movable between an upright position and a reclined position, and wherein the base includes a control operably engaging the upright for biasing the upright toward the upright position.

9. The chair defined in claim 1 wherein the back support includes a pair of horizontally spaced apart recesses, and the upright includes a pair of spaced apart structural arms having ends that engage the recesses, and further having flanges spaced from the ends constructed for attachment to the back support at locations spaced from the ends.

10. The chair defined in claim 1 wherein the seat is operably supported on the base for angular adjustment as well as depth adjustment.

11. A chair comprising:

a seat;

a base operably supporting the seat for movement between different depth-adjusted positions;

a back positioned with respect to the seat to support a seated user;

an upright interconnecting the back to the seat, the upright having a pair of spaced apart members defining a distance therebetween sufficient to receive a rear of the seat when the seat is depth-adjusted in a rearward direction; and a concave cover covering a part of the upright, the concave cover having a first portion located on a front side of the upright and a second portion located on an opposite side of the upright.

12. The chair defined in claim 11 wherein the back includes a rear cover that covers a rear surface of the back and that attaches to the concave cover.

13. The chair defined in claim 12 wherein the back includes a structural back support, and wherein the concave cover comprises a lower cover that includes an upper marginal edge that overlaps and is rearward of a lower marginal edge of the back support.

14. The chair defined in claim 13 wherein the back includes a flexible sheet covering a front region of the back support, the flexible sheet including a lower edge that wraps around the lower marginal edge and that extends upwardly between the lower marginal edge of the back support and the upper marginal edge of the lower cover.

15. The chair defined in claim 12 wherein the back support includes a vertical center track, and including a vertically adjustable lumbar support having a follower operably engaging the center track for vertical adjustment.

* * * * *